US010518944B2

(12) United States Patent
Choltco-Devlin

(10) Patent No.: US 10,518,944 B2
(45) Date of Patent: Dec. 31, 2019

(54) DRINKING VESSEL LID ASSEMBLY

(71) Applicant: Pacific Market International, LLC, Seattle, WA (US)

(72) Inventor: Evan Michael Choltco-Devlin, Ellensburg, WA (US)

(73) Assignee: Pacific Market International, LLC, Seattle, WA (US)

( * ) Notice: Subject to any disclaimer, the term of this patent is extended or adjusted under 35 U.S.C. 154(b) by 691 days.

(21) Appl. No.: 15/151,253

(22) Filed: May 10, 2016

(65) Prior Publication Data

US 2017/0327282 A1 Nov. 16, 2017

(51) Int. Cl.

| | |
|---|---|
| ***B65D 47/14*** | (2006.01) |
| ***B65D 81/38*** | (2006.01) |
| ***B65D 25/28*** | (2006.01) |
| ***A47G 19/22*** | (2006.01) |
| ***B65D 43/02*** | (2006.01) |
| ***B65D 43/26*** | (2006.01) |
| ***B65D 51/24*** | (2006.01) |

(52) U.S. Cl.

CPC ..... *B65D 47/14* (2013.01); *A47G 19/2272* (2013.01); *B65D 25/28* (2013.01); *B65D 43/02* (2013.01); *B65D 43/26* (2013.01); *B65D 51/24* (2013.01); *B65D 81/38* (2013.01); *B65D 2525/283* (2013.01)

(58) Field of Classification Search

CPC ..... B65D 47/14; B65D 43/02; B65D 43/26; B65D 51/24; B65D 81/38; B65D 2525/283; A47G 19/2272

See application file for complete search history.

(56) References Cited

U.S. PATENT DOCUMENTS

| | | | | |
|---|---|---|---|---|
| 3,856,172 | A * | 12/1974 | Wailes | A47J 41/022 215/364 |
| 4,960,218 | A * | 10/1990 | Toida | A47J 41/0027 215/311 |
| 5,169,016 | A | 12/1992 | Hinz, Jr. | |
| 5,392,967 | A * | 2/1995 | Satomi | A47J 41/0027 215/311 |
| 6,702,138 | B1 * | 3/2004 | Bielecki | A47G 19/2272 220/254.9 |

(Continued)

*Primary Examiner* — Andrew D Perreault

(74) *Attorney, Agent, or Firm* — Davis Wright Tremaine LLP; George C. Rondeau, Jr.

(57) ABSTRACT

A lid assembly is provided comprising a lid main body and a lid valve subassembly removably attachable to the lid main body. The lid main body includes an upper portion having a drinking aperture and a first attachment element positioned below the upper portion in a lid cavity. The lid valve subassembly includes a subassembly main body, a sealing member, and an attachment collar rotatably attached to the subassembly main body. The attachment collar may be rotatable about an axis of rotation relative to the subassembly main body to selectively transition the lid assembly between an integrated configuration with the lid valve subassembly secured to the lid main body and a cleaning configuration with the lid valve subassembly separated from the lid main body. A second attachment element on the lid valve subassembly may engage with the first attachment element to releasable secure the lid assembly in the integrated configuration.

35 Claims, 12 Drawing Sheets

(56) References Cited

U.S. PATENT DOCUMENTS

| | | | | |
|---|---|---|---|---|
| 7,073,678 | B1 * | 7/2006 | Dibdin | A47G 19/2272 220/254.1 |
| 2010/0237078 | A1 | 9/2010 | Lentz et al. | |
| 2011/0198349 | A1 * | 8/2011 | Lane | A47G 19/2272 220/203.04 |
| 2015/0060448 | A1 | 3/2015 | Coon et al. | |
| 2015/0072058 | A1 * | 3/2015 | Johnson | A47J 31/0615 426/431 |
| 2015/0173539 | A1 * | 6/2015 | Mason | A47G 19/2272 220/707 |
| 2015/0344199 | A1 | 12/2015 | Chiou et al. | |
| 2016/0106241 | A1 * | 4/2016 | Wong | A47G 19/2272 220/254.5 |

* cited by examiner

DRINKING VESSEL LID ASSEMBLY

FIELD OF INVENTION

The present invention relates to removable lids for drinking vessels and more precisely to one-handed cam lids having a removable sealing element.

BACKGROUND

Some drinking vessel lids have removable sealing mechanisms for separate cleaning. However, some sealing mechanisms may be difficult to install. Some removable sealing element designs fail to adequately insulate a heated liquid, e.g. a beverage, in the drinking vessel. Some sealing elements provided with insulation may obstruct the flow of the heated liquid to the drinking aperture. Additionally, the lip of a drinking vessel near the drinking aperture may become contaminated if the drinking vessel falls on the floor, for example.

DETAILED DESCRIPTION

Figure 1:
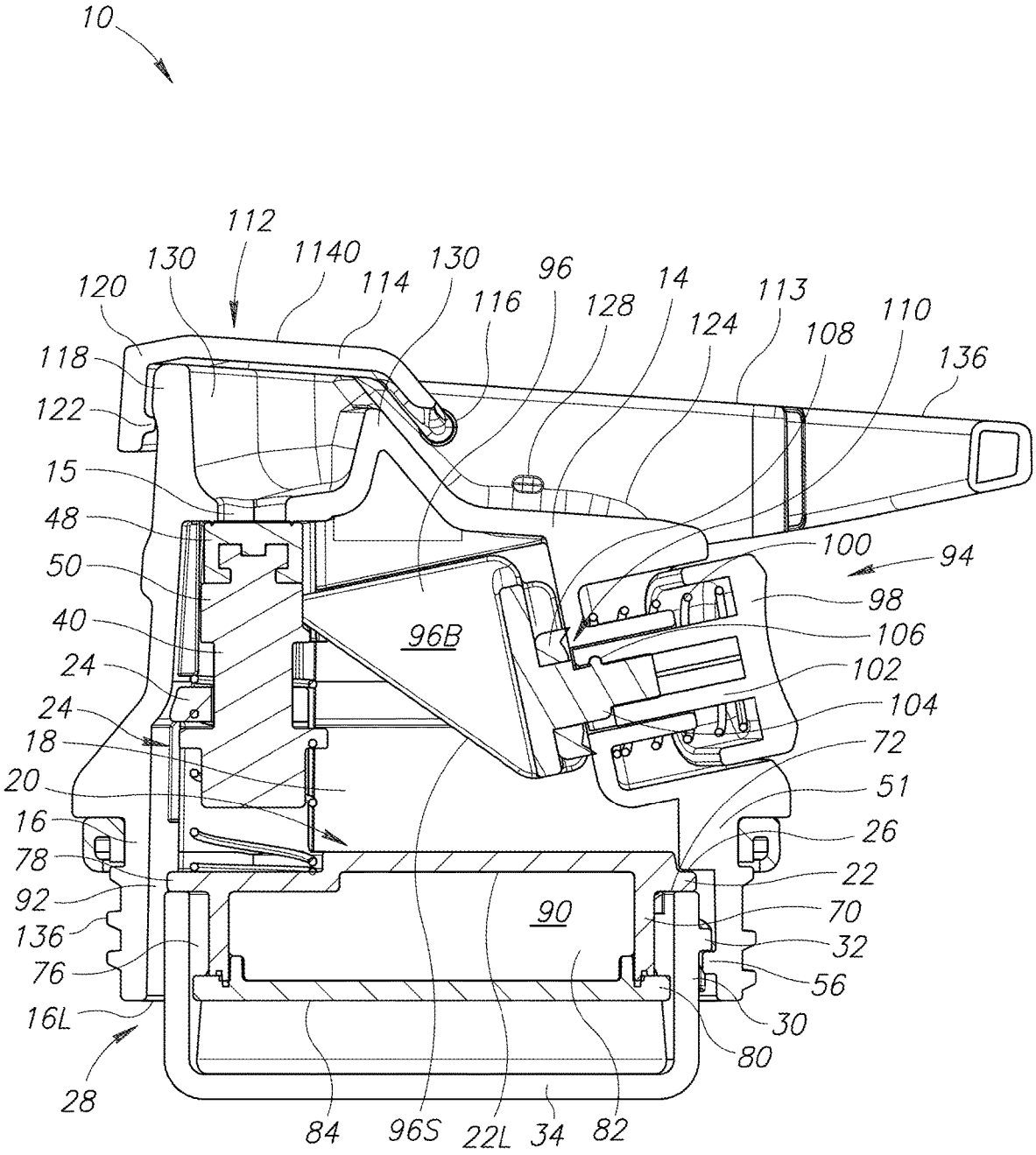
FIG. 1 illustrates a cross-sectional side view of a lid assembly.
Figure 2A:
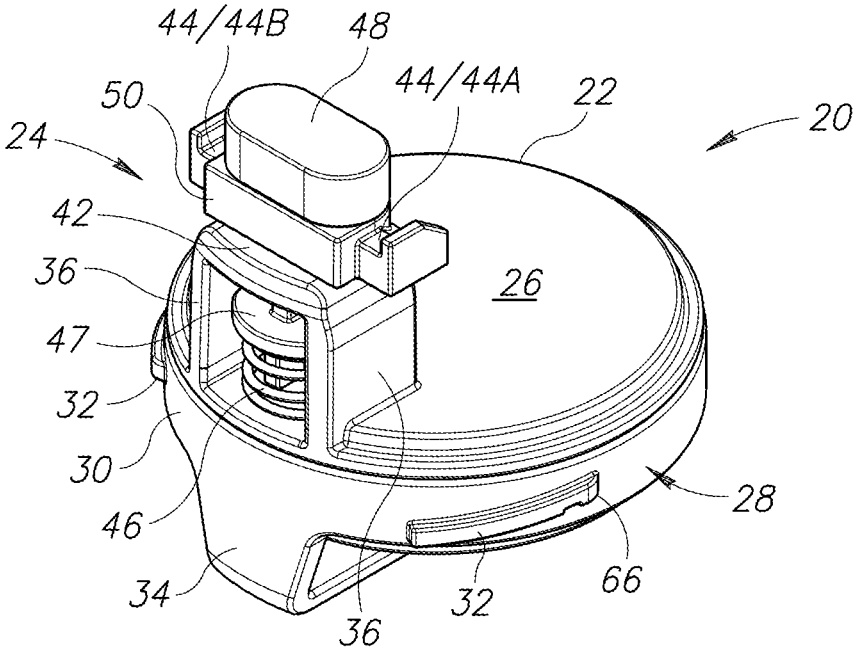
FIG. 2A illustrates a first top perspective view of a lid valve subassembly of the lid assembly of FIG. 1.
Figure 2B:
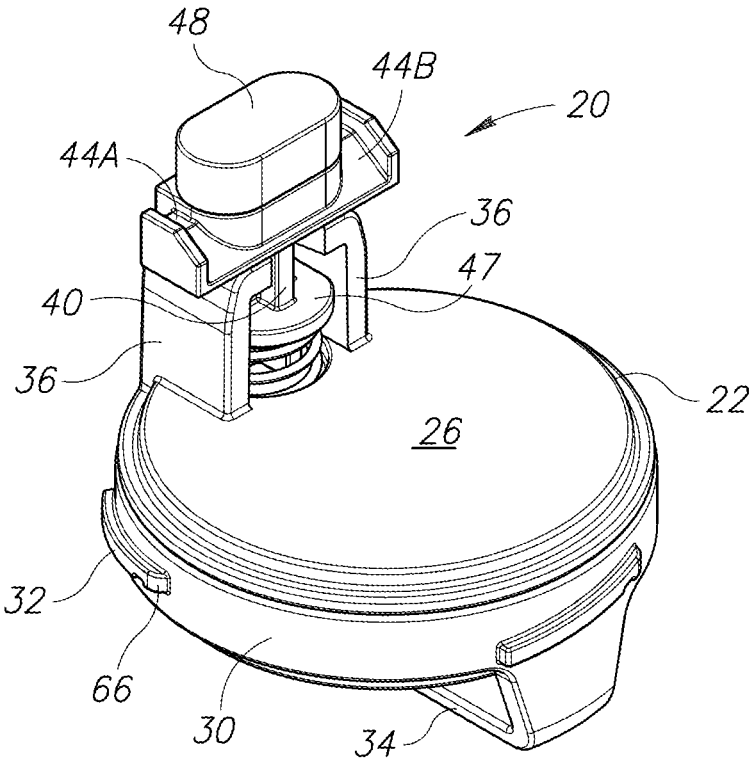
FIG. 2B illustrates a second top perspective view of the lid valve subassembly of FIG. 2A.
Figure 3:
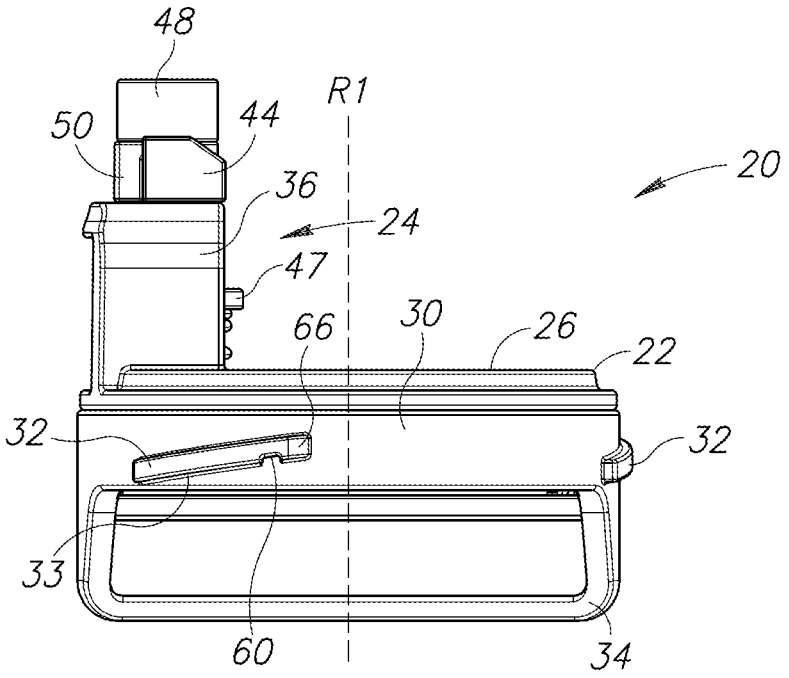
FIG. 3 illustrates a side view of the lid valve subassembly of FIG. 2A.
Figure 4:
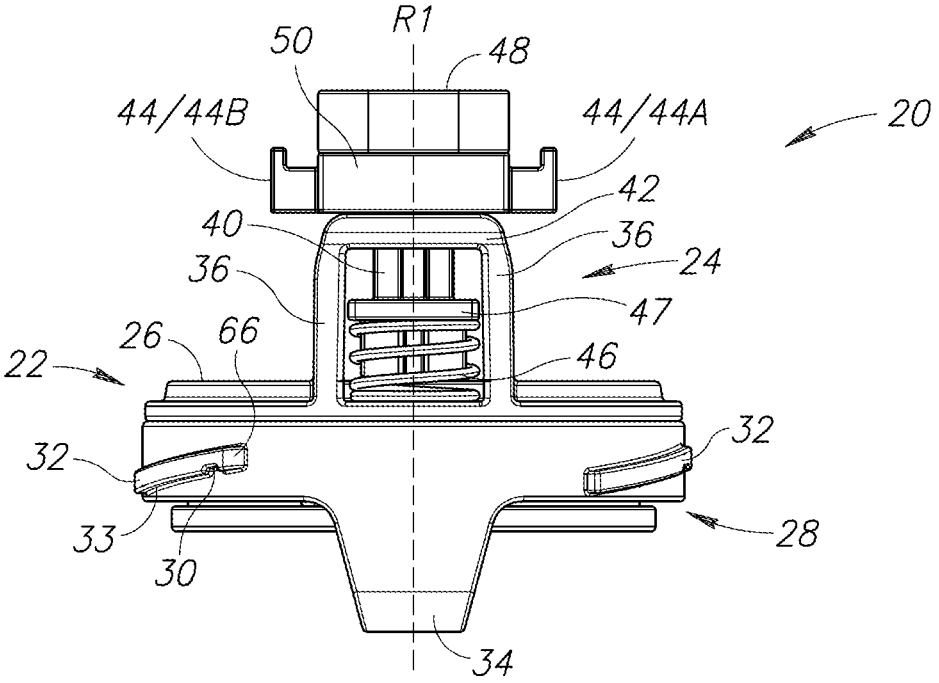
FIG. 4 illustrates a front view of the lid valve subassembly of FIG. 2A.

A drinking vessel lid assembly 10 is shown in FIG. 1. The lid assembly 10 includes a substantially cylindrical lid main body 12 having an upper portion 14 provided with a drinking aperture 15 through which liquid may flow. A cavity wall 16 extends downwardly from the upper portion 14 defining a lid cavity 18. A lid subassembly 20 may be selectively installed in and removed from the lid cavity 18, as described below.

Figure 5:
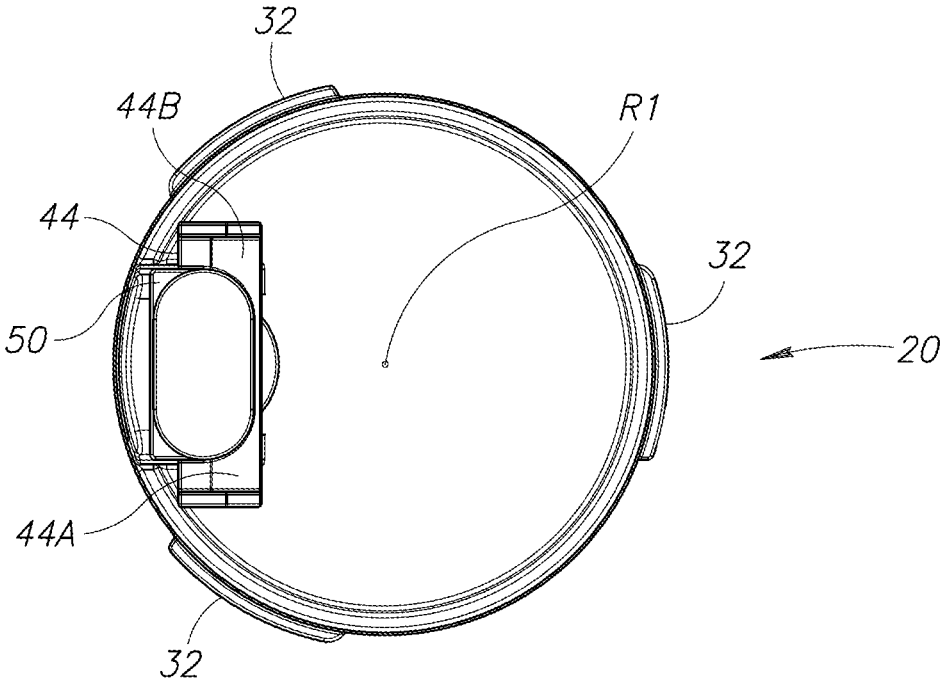
FIG. 5 illustrates a top plan view of the lid valve subassembly of FIG. 2A.
Figure 6:
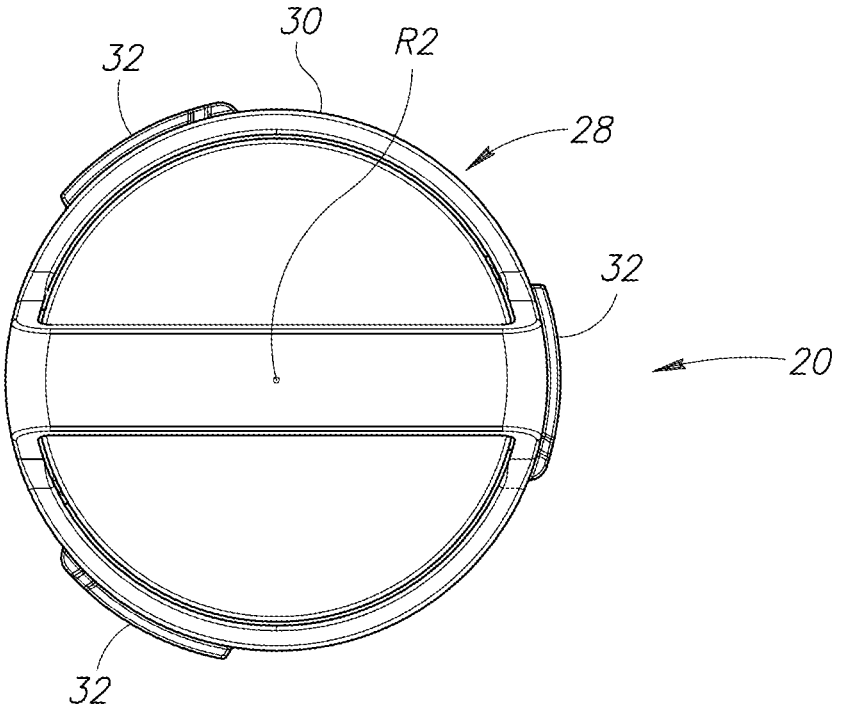
FIG. 6 illustrates a bottom plan view of the lid valve subassembly of FIG. 2A.

A subassembly main body 22 of the lid valve subassembly 20 has a sealing member 24 projecting from an upper surface 26 thereof, as shown in FIGS. 2A, 2B, 3, and 4. An attachment collar 28 is rotatably attached to a lower portion of the subassembly main body 22. The attachment collar 28 includes a collar perimeter wall 30 with an annular shape that at least partially surrounds the lower portion of the subassembly main body 22. One or more elongated first attachment elements 32 extend outward from an outwardly facing peripheral surface of the collar perimeter wall 30, as shown in FIGS. 5 and 6. The collar perimeter wall 30 is mounted to the lower portion of the subassembly main body 22 for limited rotation relative thereto about an axis of rotation R1. The first attachment elements 32 are spaced apart from one another around the outer peripheral surface of the collar perimeter wall 30 and extend peripherally along the collar perimeter wall. The first attachment elements 32 may slope upward along the periphery of the collar perimeter wall 30 so that one end of each of the first attachment elements is closer to the upper surface 26 than the other end. Each of the first attachment elements 32 may include an elongated downwardly facing first attachment surface 33.

In the present embodiment, the attachment collar 28 includes a handle 34 projecting downwardly from the collar perimeter wall 30 to facilitate a user rotating the collar perimeter wall 30, and hence the attachment collar 28, relative to the subassembly main body 22, at least through a limited range of rotating as described below in greater detail. In other embodiments, the collar perimeter wall 30 of the attachment collar 28 may be provided with a textured surface or indents to facilitate the user gripping the collar perimeter wall to rotate the attachment collar.

The sealing member 24 includes a pair of spaced-apart support members 36 projecting upwardly from the upper surface 26 of the subassembly main body 22. The support members 36 are laterally offset from each other on opposite sides of a retaining housing 38 therebetween for retaining an elastic element 46 described below. An upper transverse support portion 42 extends between and is supported by the upper ends of the support members 36 in a position above the upper surface 26 of the subassembly main body 22. A shaft 40 extends through a centrally-located aperture extending through the transverse support portion 42. A transverse crossbar portion 44 at an end of the shaft 40 has spaced-apart lateral portions 44A and/or 44B with upwardly facing sloped cam follower surfaces for vertical actuation of the shaft, as described below. The elastic element 46, such as a compression spring, is positioned in the retaining housing 38 between the support members 36 and has an upper end thereof in contact with a lower side of a disc-shaped wall portion 47 of the shaft 40 located below the transverse support portion 42. A lower end of the elastic element 46 is in contact with the upper surface 26 of the subassembly main body 22. The elastic element 46 biases the shaft 40 away from the upper surface 26 and holds a sealing element 48 in sealing engagement with the portion of the upper portion 14 of the lid main body 12 surrounding the drinking aperture 15 when the lid subassembly 20 is installed in the lid main body 12 and in a closed state, as shown in FIG. 1. Upward travel of the shaft 40 when the lid valve subassembly 20 is removed from the lid cavity 18 is limited by an upper side of the disc-shaped wall portion 47 engaging a lower side of the transverse support portion 42.

Figure 8:
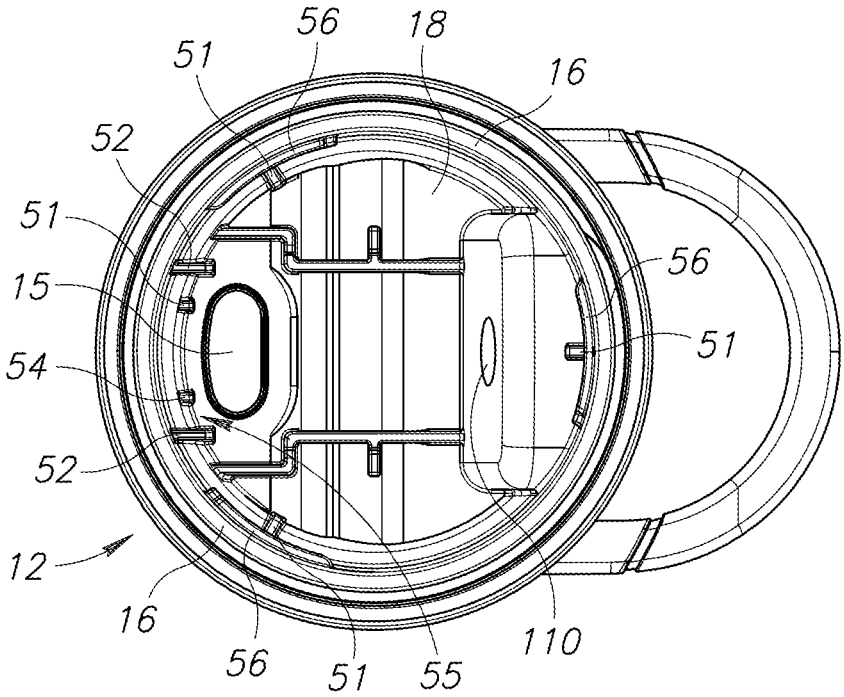
FIG. 8 illustrates a bottom view of a lid main body of the lid assembly of FIG. 1.
Figure 9:
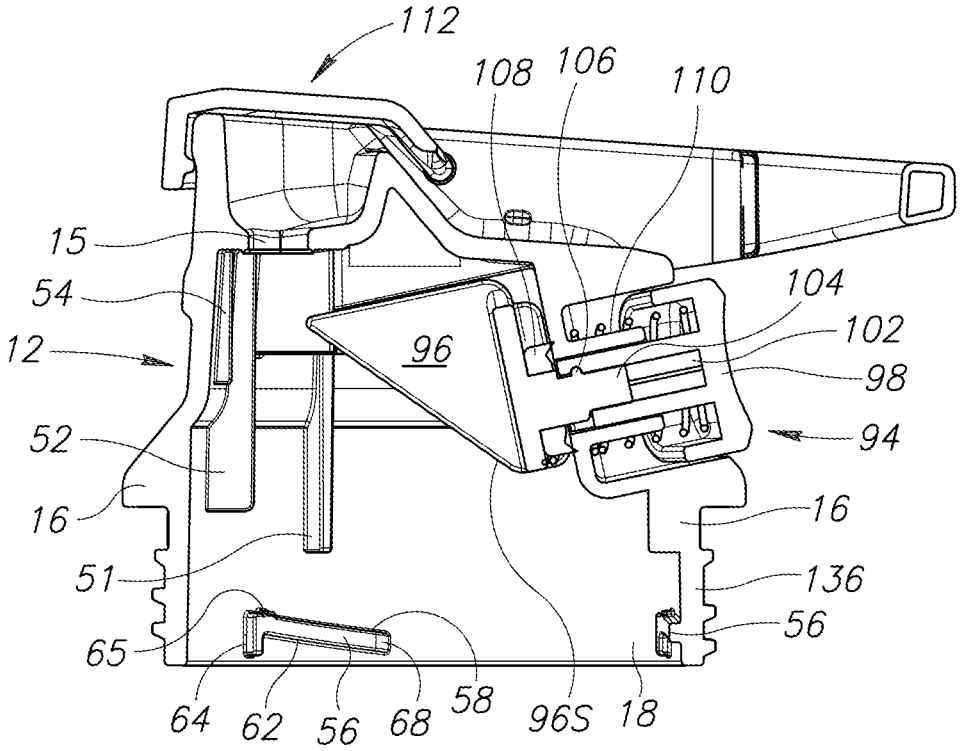
FIG. 9 illustrates a cross-sectional side view of the lid main body of FIG. 8.
Figure 10:
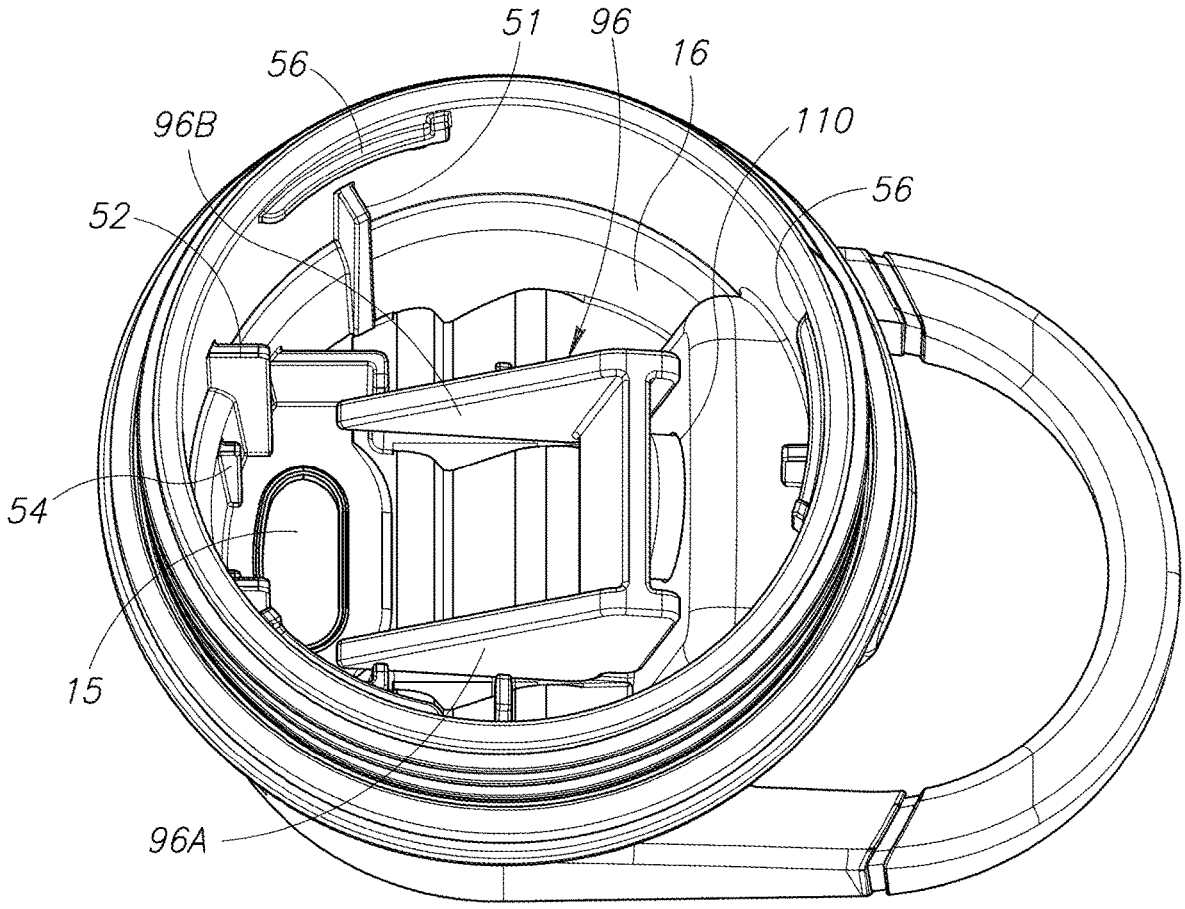
FIG. 10 illustrates a bottom perspective view of the lid main body of FIG. 8.

The lid cavity 18 is sized and shaped to receive the sealing member 24 and at least a portion of the subassembly main body 22. In the present embodiment, the inner surface of the cavity wall 16 has a cylindrical shape (see FIGS. 8 and 10) to receive the subassembly main body 22 therein and which has a corresponding cylindrical shape and at least a part of the attachment collar 28. A guide element 50 is provided on the sealing member 24 and extends outward toward the adjacent portion of the cavity wall 16 when the lid subassembly 20 is installed in the lid main body 12. A pair of elongated, vertically extending first guide members 52 project inwardly from the cavity wall 16 into the lid cavity 18 at a front side surface 55 of the lid cavity 18 and are spaced apart to receive the guide element 50 of the sealing member 24 therebetween to help guide the sealing member so that the sealing element 48 is properly aligned with and seals the drinking aperture 15 when moved into the closed state. When the sealing member 24 is in a proper alignment position, the sealing member is positioned such that one or both of the first guide members 52 will be adjacent to or in contact with one or both laterally facing sides of the guide element 50 when the lid valve subassembly 20 is inserted in the lid cavity 18. The first guide members 52 thereby help to properly align the sealing element 48 with the drinking aperture 15 and also capture the guide element 50 therebetween to help prevent the sealing member 24 from rotating within the lid cavity 18. A pair of elongated, vertically extending second guide members 54 project inward from the cavity wall 16 into the lid cavity 18 at the front side surface 55 of the lid cavity 18 at a location adjacent to the drinking aperture 15. The second guide members 54 are spaced apart to engage an outwardly facing side of the guide element 50 of the sealing member 24 to space the sealing element 48 apart from the cavity wall 16 to help guide the sealing member into proper alignment with the drinking aperture 15 when being moved into the closed state.

A pair of stop elements 51 project inwardly from the cavity wall 16 into the lid cavity 18 to limit upward movement of the subassembly main body 22 within the lid cavity 18 when the lid valve subassembly 20 is inserted in the lid cavity. The stop elements 51 abut the upper surface 26 of the subassembly main body 22 when the subassembly main body is installed in the lid cavity 18.

The lid valve subassembly 20 and the lid main body 12 may be provided with corresponding attachment portions to removably secure together the lid subassembly and the lid main body. When the sealing member 24 is aligned with the drinking aperture 15, with the guide element 50 between the first guide members 52, the lid cavity 18 may receive at least a portion of the subassembly main body 22 and the attachment collar 28 within the lid cavity 18 and in position to engage the attachment collar 28 with the cavity wall 16. One or more elongated second attachment elements 56 project inward from the cavity wall 16 at locations corresponding to the locations of the first attachment elements 32 of the collar perimeter wall 30 so as to be in position to be engaged by the first attachment elements upon rotation of the collar perimeter wall and thereby releasably and removably attach the lid valve subassembly 20 to the lid main body 12. Each of the second attachment elements 56 extends peripherally along the cavity wall 16. The second attachment elements 56 each include an elongated upwardly facing second attachment surface 58 configured to engage with a corresponding portion of the elongated downwardly facing first attachment surface 33 of one of the first attachment elements 32 when the attachment collar 28 is rotated into a locked rotational position. The second attachment surfaces 58 may slope upward along the periphery of the cavity wall 16 such that one end of each of the second attachment elements is closer to the upper portion 14 of the lid main body 12 than the other end. Insertion of the lid valve subassembly 20 into the lid main body 12 is commenced by aligning the guide element 50 between the first guide member 52, and rotating the attachment collar 28 such that the first attachment elements 32 are positioned offset from the second attachment elements 56. The lid valve subassembly 20 may then be moved into the lid cavity 18. Next the attachment collar 28 may be rotated in a clockwise direction when viewed from below relative to the subassembly main body 22 and the lid main body 12 to place the first attachment elements 32 over the second attachment elements 58 with the downwardly facing first attachment surface 33 in co-extensive engagement with the upwardly facing second attachment surface 58. When in this position a detent recess 60 on the downwardly facing first attachment surface 33 releasably engages a detent protrusion 65 on the upwardly facing second attachment surface 58 to releasably lock the attachment collar 28 in the locked rotational position relative to the lid main body 12. Further clockwise rotation of the attachment collar 28 relative to the lid main body 12 is prevented by a stop wall 72A on an inward side of the collar perimeter wall engaging a stop 74 on the subassembly main body 22. Another stop wall 72B on the inward side of the collar perimeter wall 30 is positioned to engage the stop 74 on the subassembly main body 22 to limit counterclockwise rotational movement of the attachment collar 28 relative to the subassembly main body 22. In other embodiments, alternative means may be used to releasably and removably attach the lid subassembly 20 to the lid main body 12.

In the event the first attachment elements 32 are not positioned adequately offset from the second attachment elements 56 when the lid valve subassembly 20 is inserted into the lid cavity 18, the first attachment elements 32 will engage a downwardly facing surface 62 of the second attachment elements 56 and full insertion will be prevented. To limit the clockwise rotation of the attachment collar 28 relative to the lid main body 12 in the situation, the second attachment elements 56 each include a downwardly projecting stop wall 64.

Figure 7:
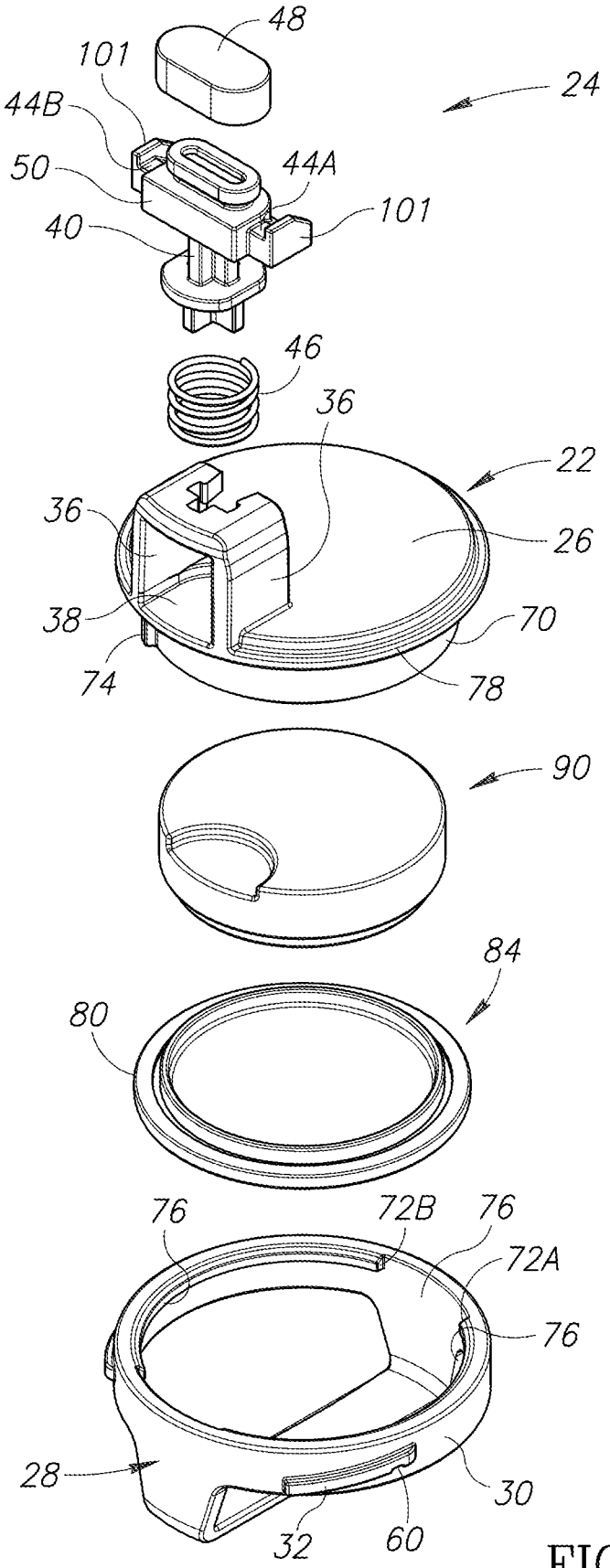
FIG. 7 illustrates an exploded view of the lid valve subassembly of FIG. 2A.

The attachment collar 28 is operable to slidably rotate relative to the subassembly main body 22. In particular, the attachment collar 28 rotates along cylindrical subassembly sidewall 70 extending downwardly from the subassembly main body 22 (see FIG. 7). The stop 74 project outward from the subassembly sidewall 70. The attachment collar 28 has a pair of inwardly projecting flange 76 each extending partially about the attachment collar. The attachment collar 28 is retained by the subassembly main body 22 by the flange 76 being trapped between an upper rim portion 78 and a lower rim portion 80 of the subassembly main body 22. The upper and lower rim portions 78 and 80 are vertically spaced apart to allow the vertical movement of the subassembly main body 22 needed to move the sealing member 24 into and out of sealing engagement with the portion of the upper portion 14 of the lid main body 12 needed to open and close the drink aperture.

An insulation cavity 82 may be provided in the subassembly main body 22. The insulation cavity 82 is located below the upper surface 26 of the subassembly main body 22, inward of the subassembly sidewall 70 which define a downwardly open recess which is closed by a subassembly cap (see FIGS. 1 and 7). When the lid assembly 10 is attached to a beverage container, the insulation 90 in the insulation cavity 88 reduces heat transfer through the lid assembly 10. Specifically, the insulation cavity 88 helps to block heat exchanged between a fluid, e.g., a beverage, in an attached beverage container and the air in an upper cavity portion 18U of the lid cavity 18 above the subassembly main body 22. The insulation cavity 88 may be sealed to prevent fluid and/or heat from leaking therein. The insulation cavity 88 may be vacuum-sealed, or substantially filled with air or a thermal insulation material 90 having a low thermal conductivity, such as Styrofoam, polyurethane, polyethylene, fiberglass or other insulation material known in the art.

Figure 13:
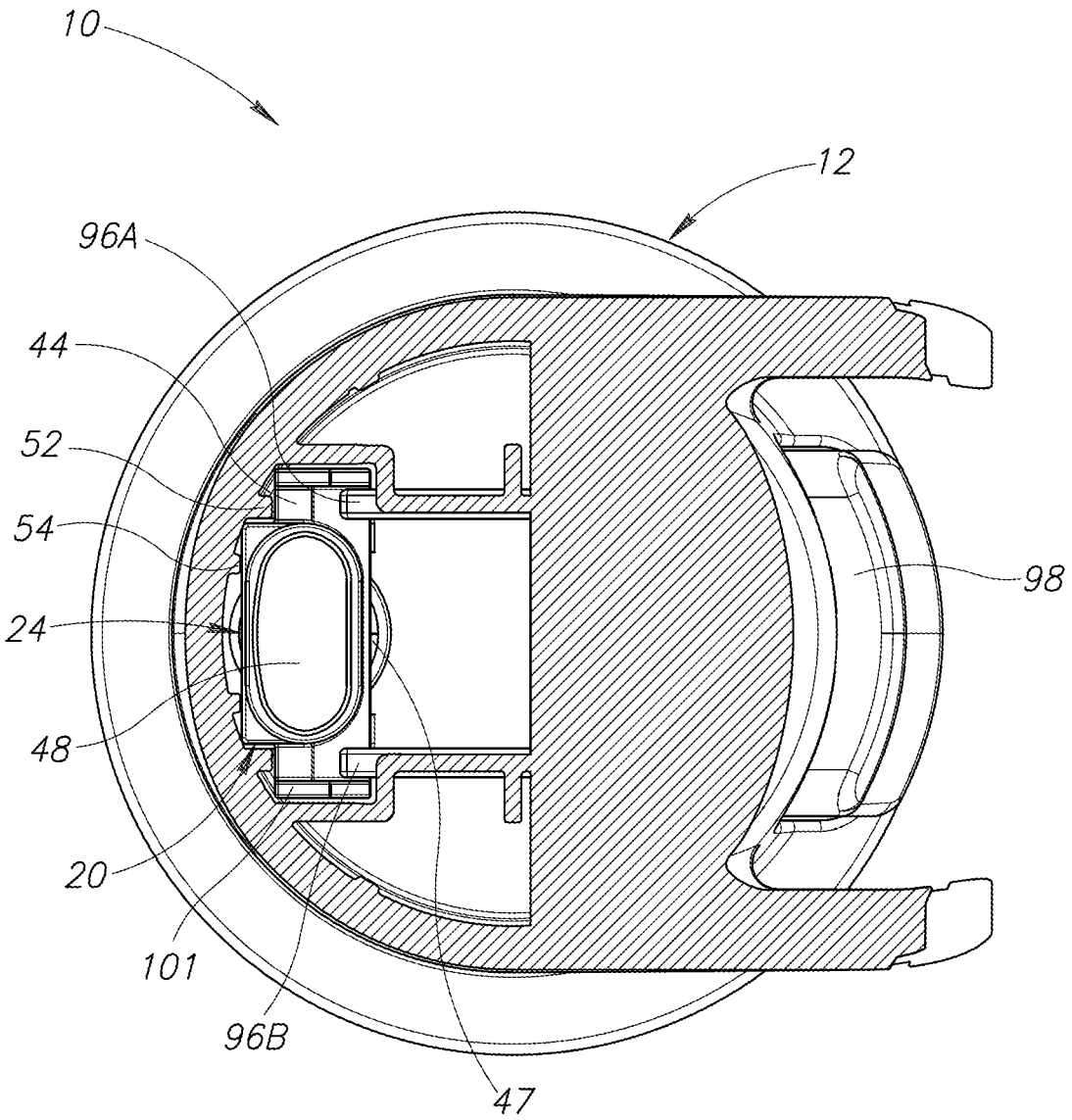
FIG. 13 illustrates a cross-sectional top view of the lid assembly of FIG. 1.

A process of attaching the lid valve subassembly 20 to the lid main body is described with reference to FIGS. 13, 14A, 14B, 15A and 15B. In a first step, the sealing member 24 is positioned at the proper alignment position relative to the support members 36, as shown in FIG. 13 and described above. In a second step, the subassembly main body 22 of the lid valve subassembly 20 may be inserted and pushed upward into the lid cavity 18. The upper surface of the upper surface 26 of the subassembly main body 22 may contact the stop elements 51 thereby preventing further upward movement of the subassembly main body within the lid cavity 18 (see FIG. 1).

Figure 14A:
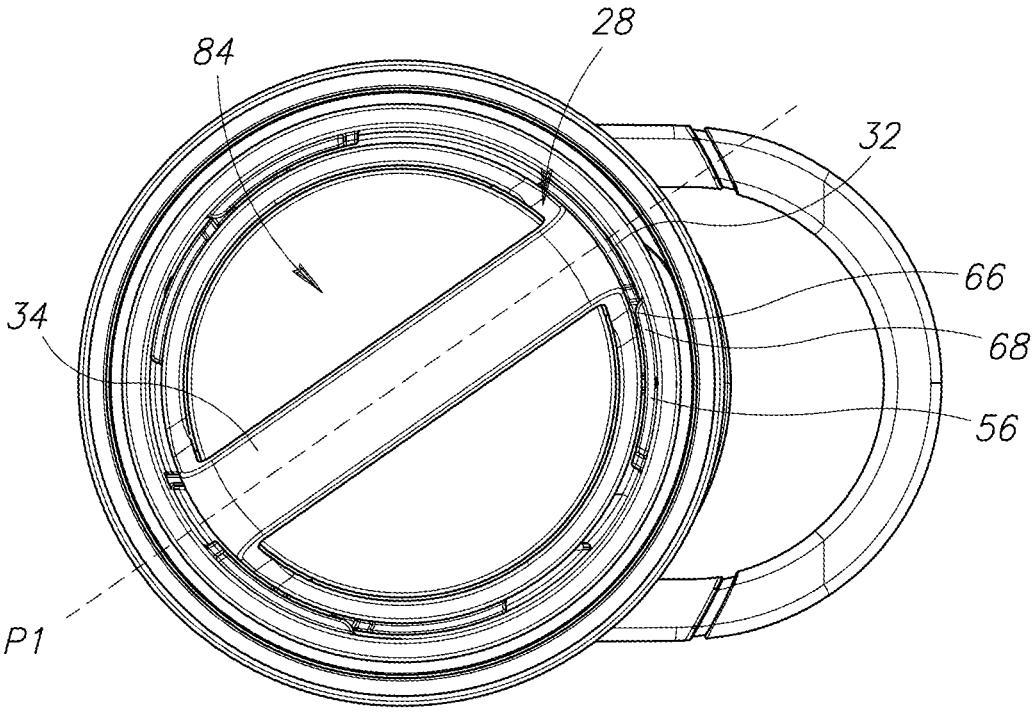
FIG. 14A illustrates a bottom plan view of the lid assembly of FIG. 1 with an attachment collar of the lid valve subassembly in a first rotational position.
Figure 14B:
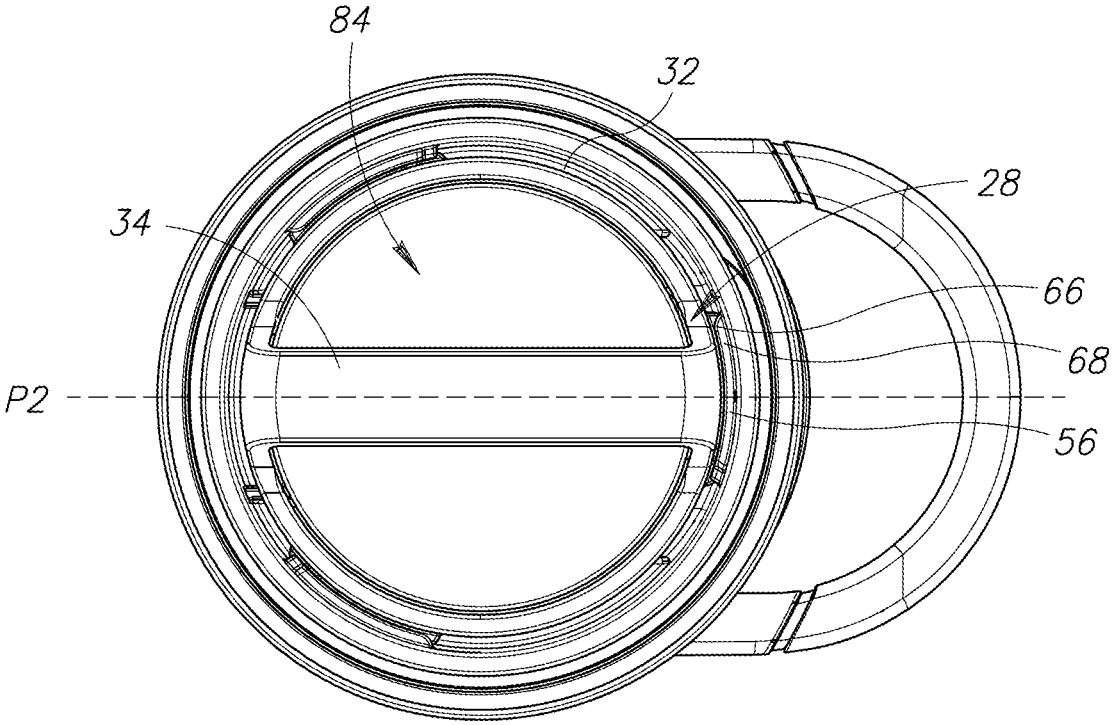
FIG. 14B illustrates a bottom plan view of the lid assembly of with the attachment collar of the lid valve subassembly in a second rotational position.

In a third step, the attachment collar 28 is positioned in an initial rotational position P1 about the axis of rotation R1 at which each of the first attachment elements 32 is positioned between peripherally adjacent ones of the second attachment elements 56 (see FIG. 14A). In the initial rotational position P1, a first end 66 of the first attachment element 32 is adjacent to and spaced apart from a first end 68 of the second attachment element 56 along the periphery of the cavity wall 16.

Figure 15A:
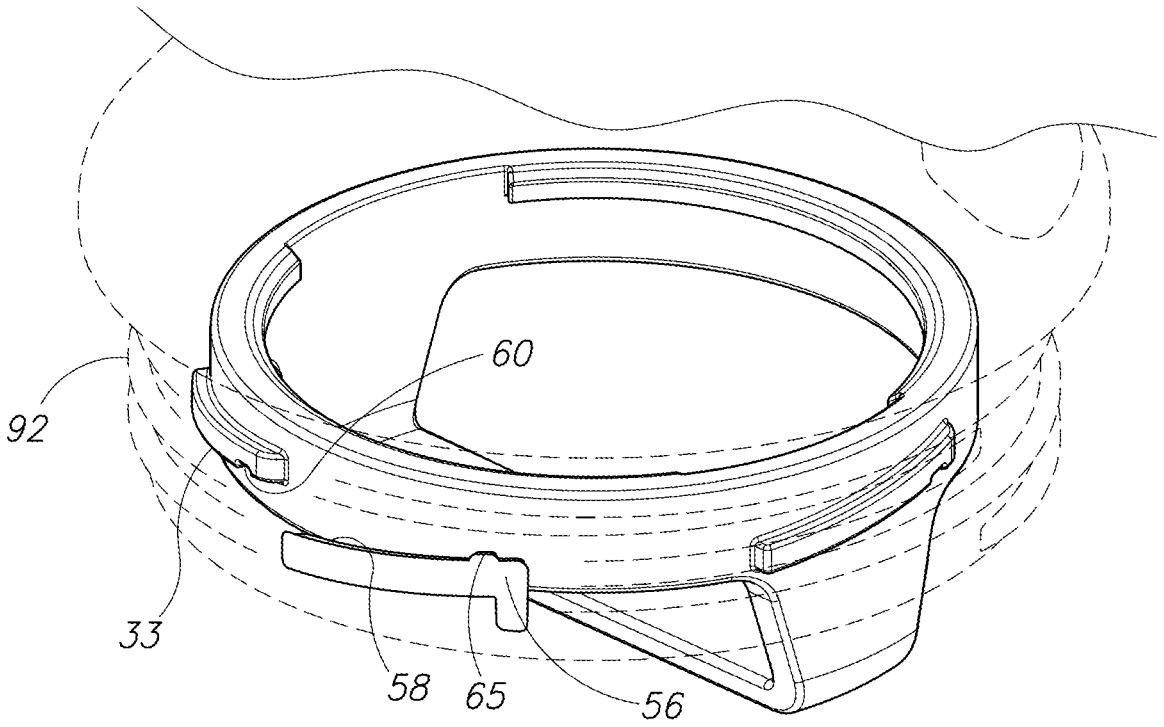
FIG. 15A illustrates a semi-transparent perspective view of the lid assembly of FIG. 14A with the attachment collar of the lid subassembly in the first rotational position.

In a fourth step, the attachment collar 28 is moved upwardly to a position at which the first end 66 of the first attachment element 32 is above (i.e., closer to the upper portion 14) the first end 68 of the second attachment portion 56 (see FIG. 15A).

Figure 15B:
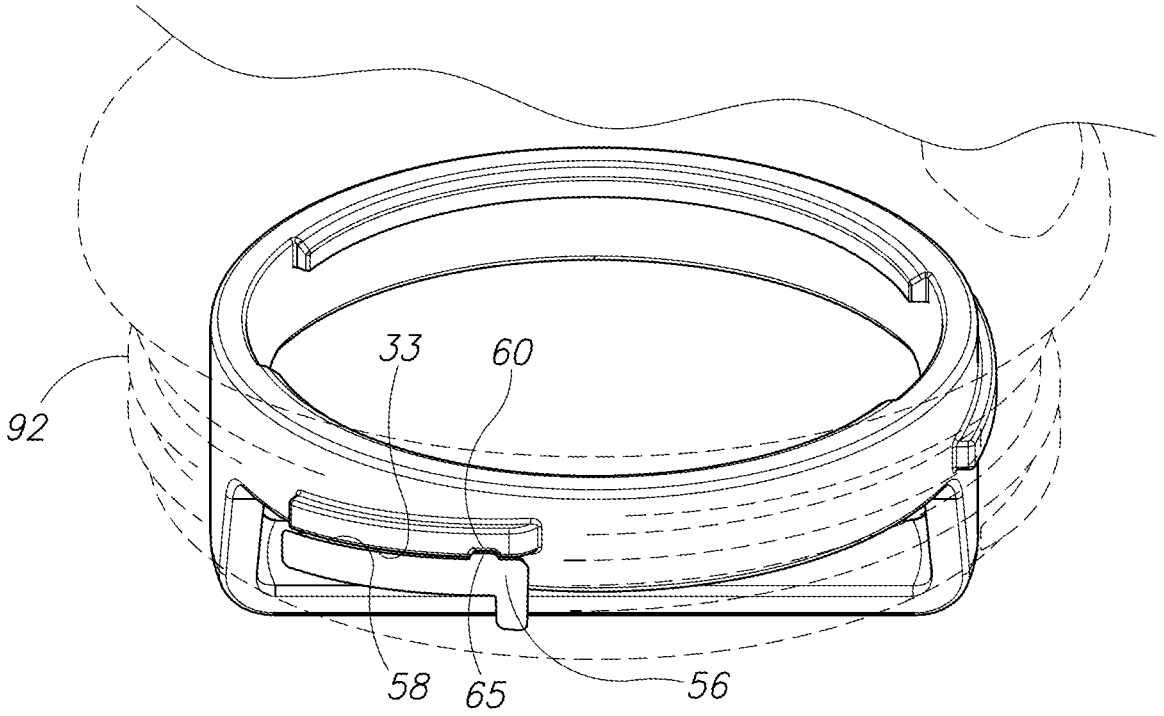
FIG. 15B illustrates a semi-transparent perspective view of the lid assembly of FIG. 1 with the attachment collar of the lid subassembly in the second rotational position.

In a fifth step, the attachment collar 28 is rotated clockwise (when viewed from below) about the axis of rotation R1 using the handle 34 to an engagement position P2 at which each of the first attachment elements 32 of the attachment collar slidably engage and overlap with a corresponding one of the second attachment elements 56 of the lid main body 12 (see FIG. 14B), thereby removably attaching the lid subassembly 20 to the lid main body 12. Specifically, the collar perimeter wall 30 is rotated in the rotational direction which causes the first end 66 to move toward the adjacent second attachment element 56 (i.e., clockwise when the lid subassembly 20 is viewed from the bottom side). The collar perimeter wall 30 is rotated to a position at which the first attachment surfaces 32 engage with or contact the second attachment surfaces 58, as best shown in FIG. 15B. When the attachment collar 28 is in the engagement position P2, the first attachment elements 32 are each at least partially overlapping one of the second attachment elements (see FIG. 15A).

In this position, the detent recess 60 of the attachment collar 28 engages with or interlocks with the detent protrusion 65 of the lid main body 12 to help secure the rotational position of the lid subassembly 20 when inserted in the lid cavity 18. The locations of the detent protrusion and the detent recess may be reversed in other embodiments.

The lid valve subassembly 20 may be easily detached from the lid main body 12 by rotating the collar perimeter wall 30, using the handle 34 to disengage the first attachment elements 32 from the second attachment elements 56, and the lid valve subassembly may be withdrawn from the lid cavity 18. The withdrawn lid valve subassembly 20 is then disconnected from the lid main body 12 and may be cleaned by hand or put in a dishwasher without the lid main body blocking cleaning solution from reaching any component parts of the lid valve subassembly needing cleaning.

When the lid valve subassembly 20 is attached to the lid main body 12, the subassembly main body 22 and the attachment collar 28 at least partially block the fluid, e.g., the beverage, in the beverage container from flowing through a central portion of the lid cavity 18. When the attachment collar 28 is positioned at the engagement position P2, one or more outer portions of the perimeter wall of the attachment collar 28 are spaced apart from a corresponding one or more inner portions of the cavity wall 16 to define one or more fluid paths 92 therebetween, as shown in FIGS. 1 and 15B. The lid valve subassembly 20 spans across substantially the entire lid cavity 18 except the small spaces defining the fluid paths 92 and blocks fluid from flowing through a central portion of the lid subassembly located along the axis of rotation R1. Each of the one or more fluid paths 92 extends between the lid cavity upper portion 18U and a lower opening 16L of the lid cavity 16 and provides a fluid path for the fluid in an attached beverage container to reach the drinking aperture 15.

A sealing member actuation assembly 94 may actuate the sealing member 24 to selectively open and close the drinking aperture 15. A wedge-shaped actuation member 96 may engage with the crossbar portion 44 of the sealing member 24 to downwardly actuate the sealing element 48 relative to the drinking aperture 15 using a camming motion, thereby unsealing the drinking aperture and allowing fluid to flow therethrough. A button portion 98 exposed on an outwardly facing surface of the lid main body 12 is operably connected to the actuation member 96. The button portion 98 is operable to transversely move the actuation member 96 toward an adjacent portion of the cavity wall 16. A compressible elastic member 100 may bias the actuation member 96 and/or the button portion 98 outwardly and away from the sealing member 24 to maintain the sealing element 48 in a sealed position at the drinking aperture 15 when the user is not depressing the button portion.

The actuation member 96 has a pair of laterally spaced apart cam members 96A and 96B each with a downwardly facing sloped cam surfaces 96S, each oriented at an angle complementary to an angle of an upwardly facing sloped cam follower surfaces of one of the laterally spaced apart lateral portions 44A and 44B. Each of the lateral portions 44A and 4B has a laterally outward retaining wall 101 to limit lateral movement of the cam members 96A and 96B during their engagement with the lateral portions 44A and 4B, respectfully. Pressing the button portion 98 inward transversely moves the sloped surfaces 96S to push the crossbar portion 44 downward, thereby separating the sealing element 48 from the drinking aperture 15. The button portion 98 may transversely move the actuation member 96 using one or more connecting portions when the button portion is depressed by a user. In the present embodiment, a first connecting portion 102 of the button portion 98 extending inward from on an inward side of the button portion 96 engages with a second connecting portion 104 attached to the actuation member 96. The first connecting portion 102 and the second connecting portion 104 of the present embodiment are directly and securely attached together by complementary interlocking snap fit portions 106. At least one of the first connecting portion 102 and the second connecting portion 104 may extend through a main body aperture 110 between the lid cavity 18 and an outer surface of the lid main body 12. An annular sealing portion 108 mounted on the second connecting portion 104 moves in and out with the actuation member 96 and seals the main body aperture 110 to help prevent heat and fluid from leaking through the main body aperture when the button portion 98 is not depressed. The elastic member 46 moves the sealing member 24 to the closed state sealing the drinking aperture 15 when the button is not depressed.

Other structures may be used to operatively interconnect the button portion 98 and the actuation member 96. Other assemblies may be used to actuate the sealing member 24.

A cover member 112 may be rotatably attached to the upper portion 14 of the lid main body 12, as shown in FIGS. 1, 9, 11A, 11B and 12. The cover member 112 is rotatable between a first rotational position covering the drinking aperture 15 and a second rotational position exposing the drinking aperture for drinking therefrom. The cover member 112 has an elongated first cover portion 114 extending from a cover attachment portion 116 that corresponding engages with corresponding lid attachment portions to rotatably attach the cover member 112 to the lid main body 12. The first cover portion 114 is sized and shaped to cover the drinking aperture 15 when the cover member 112 is in the first rotational position.

Figure 11A:
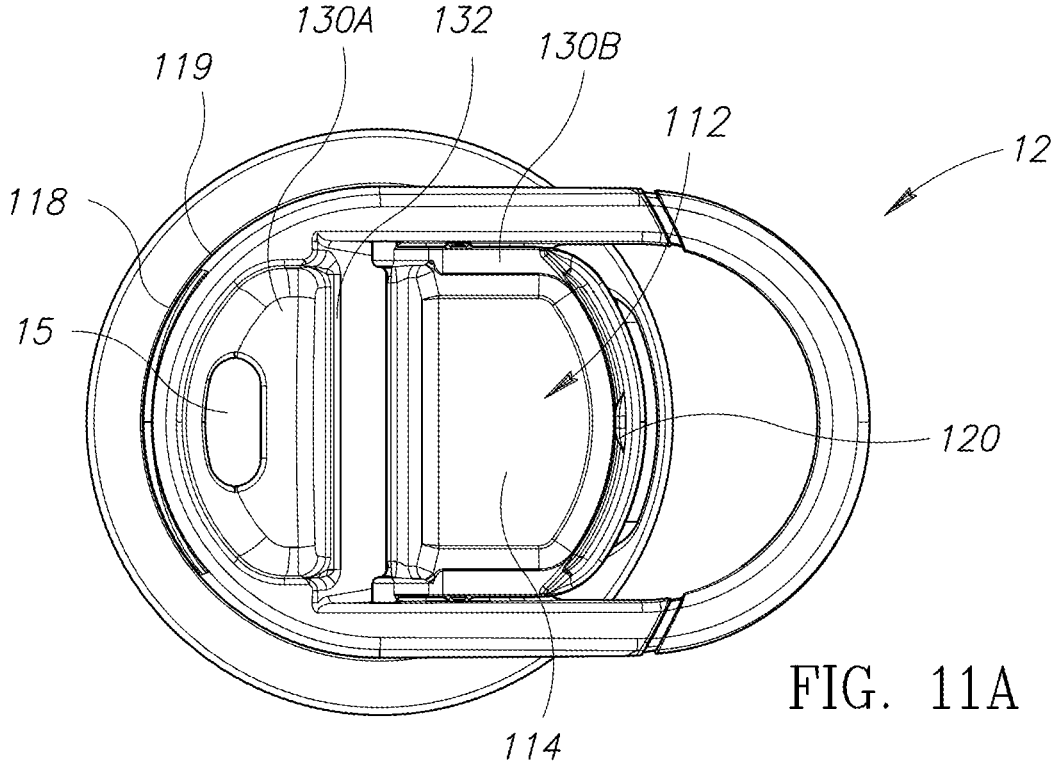
FIG. 11A illustrates a top plan view of the lid main body of FIG. 8 with a cover member in a first cover position with the drinking aperture uncovered.
Figure 11B:
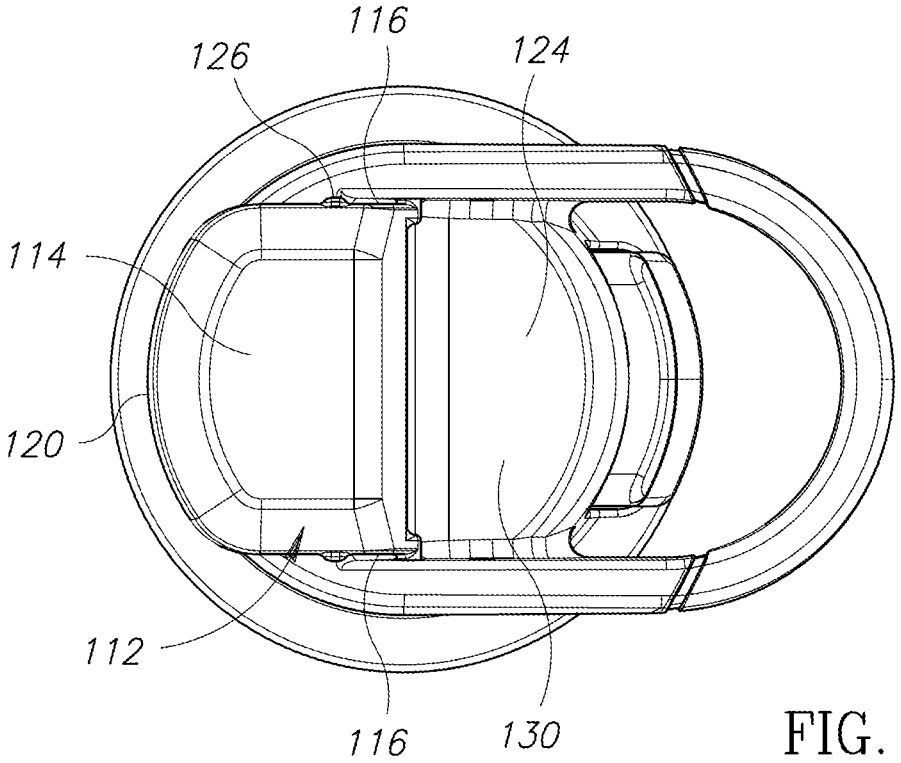
FIG. 11B illustrates a top plan view of the lid main body of FIG. 8 with the cover member in a second cover position.

The first cover portion 114 may further extend over and thereby cover a drinking lip 118 adjacent to the drinking aperture 15 when in the first rotational position. The drinking lip 118 may have an outwardly curving shape and project upwardly to above the drinking aperture 15 along an outer peripheral rim 119 of the upper portion 14. A second cover portion 120 may project downwardly from the first cover portion 114 and cover an outer surface portion of the lip 118 when the cover member 112 is in the first rotational position. The second cover portion 120 may have a shape corresponding to the shape of the drinking lip 118 and/or outer peripheral rim 119 of the upper portion 14, as shown in FIG. 11B. The second cover portion 120 may help to protect the drinking lip 118 from contamination when the cover member 112 is in the first rotational position. A detent protrusion 122 may project from an inner side of the second cover portion 120 facing the drinking lip 118 when the cover member 112 is in the first rotational position. The protruding portion 122 may engage with a recess detent of the drinking lip 118 to releasably secure the cover member 112 in the first rotational position.

The cover member 112 may be rotated rearward from the first rotational position to a second rotational position (see FIGS. 11A and 12) within a cover storage area 124 of the upper portion 14. The cover member 112 is positioned away from the drinking aperture 15 when in the second rotational position to allow uninhibited access thereto for drinking. The cover member 112 of the present embodiment is rotatable about an axis of rotation extending between the cover attachment portions 116. The cover member 112 rotates upward and rearward from the first rotational position to the second rotational position where an upper surface 114U of the first cover portion 114 faces an upper surface of the upper portion 14 of the lid main body 12. The cover member 112 may be provided with cover detents 126 configured to engage with corresponding upper portion detents 128 to releasably secure the cover member 112 in the second rotational position. The cover detents 126 may be disposed on lateral sides of the cover member 112 to engage with the upper portion detents 128 located on inwardly facing portions of the outer peripheral rim 119.

Figure 12:
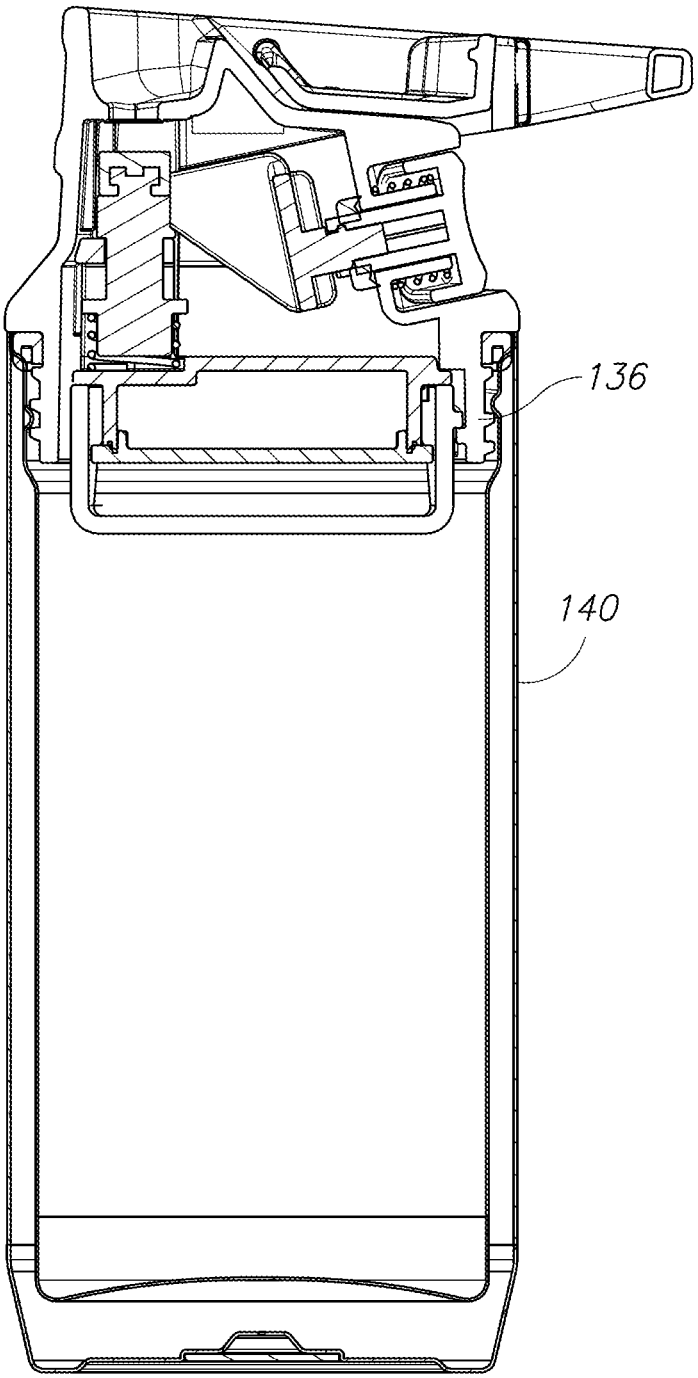
FIG. 12 illustrates a cross-sectional side view of the lid assembly of FIG. 1 attached to a beverage container.

The outer peripheral rim 119 and/or the drinking lip 118 may extend upwardly and along with a transversely extending ridge 130 form a drinking well 132, as shown in FIGS. 1 and 12 at a front side of the lid main body 12. When the cover member 112 is in the first rotational position, the first cover portion 114 may extend between the ridge 130 and the drinking lip 118 to cover the drinking well 132 and the drinking aperture 15 at the bottom of the drinking well.

A U-shaped handle portion 134 extends rearwardly from the lid main body 12.

The lid main body 12 has a threaded attachment portion 136 that may threadably attach the lid assembly 10 to a drinking vessel 140, as shown in FIG. 12. Other attachment means may be used to removably join the lid assembly 10 to the drinking vessel 140 in a fluid-tight configuration, such as a bayonet mount or friction fit, and may include an O-ring or gasket sized to seal the lid assembly 10 to the drinking vessel 140. While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Accordingly, the invention is not limited except as by the appended claims.

What is claimed is:

1. A drinking vessel lid assembly for attachment to a drinking vessel, the drinking vessel lid assembly comprising:

a lid main body including:

an upper portion having a drinking aperture laterally offset from a central axis of the upper portion and extending partially about the upper portion;

an outer perimeter sidewall;

a lid cavity extending downwardly from the upper portion; and a first attachment element;

a lid subassembly removably attachable to the lid main body, the lid subassembly including:

a sealing member supporting a sealing element;

a subassembly main body supporting the sealing member with the sealing member extending upwardly from the subassembly main body, the subassembly main body being removably insertable to an insertion position within the lid cavity and held therein with the sealing member restrained against rotation relative to the lid main body and the sealing element in vertical alignment with the drinking aperture, the sealing element configured for upward displacement into a closed position whereat the sealing element seals the drinking aperture, and for downward displacement into an opened position whereat the sealing element is spaced apart from the drinking aperture when the subassembly main body is in the insertion position; and an attachment collar rotatably attached to the subassembly main body and configured to rotate relative to the subassembly main body without rotating the sealing member relative to the lid main body when the subassembly main body is in the insertion position within the lid cavity to maintain the sealing element in vertical alignment with the drinking aperture, the attachment collar being rotatable relative to the subassembly main body to secure the lid subassembly in an integrated configuration in which the lid subassembly is secured to the lid main body with the subassembly main body in the insertion position, and to selectively transition the lid subassembly between the integrated configuration and a cleaning configuration in which the lid subassembly is separable from the lid main body, the attachment collar including a second attachment element engageable with the first attachment element when the lid subassembly is in the integrated configuration to secure the lid subassembly to the lid main body with the subassembly main body in the insertion position; and a manually operable sealing member actuator operable to move the sealing element from the closed position to the opened position when the lid subassembly is in the integrated configuration, the sealing member actuator having a manually operable actuator portion positioned at the outer perimeter sidewall and engageable by a user to effectuate movement of the sealing element from the closed position to the opened position.

2. The drinking vessel lid assembly of claim 1, wherein, when the subassembly main body is in the insertion position, the attachment collar is rotatable between a first rotational position at which the first attachment element is out of engagement with the second attachment element, and a second rotational position at which the first attachment element overlaps the second attachment element when the lid assembly is in the integrated configuration to secure the lid subassembly to the lid main body.

3. The drinking vessel lid assembly of claim 2, wherein the first attachment element includes a first detent, the second attachment element includes a second detent, and the first detent engages with the second detent to releasably secure the lid subassembly to the lid main body when the second attachment element is in the second rotational position of the attachment collar.

4. The drinking vessel lid assembly of claim 3, wherein one of the first detent and the second detent is a recessed portion, and an other of the first detent and the second detent is a protruding portion configured to mate with the recessed portion when the attachment collar is in the second rotational position.

5. The drinking vessel lid assembly of claim 2 wherein the first attachment element is arranged to prevent movement of the subassembly main body when inserted into the lid cavity from being moved to the insertion position when the second attachment element is in the second rotational position.

6. The drinking vessel lid assembly of claim 1 wherein the first attachment element has a first attachment surface oriented at an acute upward angle, and the second attachment element has a second attachment surface oriented at an acute upward angle and is slidably engageable with the first attachment surface.

7. The drinking vessel lid assembly of claim 1 wherein the subassembly main body further includes an enclosed insulation cavity spanning across the lid cavity when the subassembly main body is in the insertion position.

8. The drinking vessel lid assembly of claim 7 wherein the insulation cavity is filled with an insulation material.

9. The drinking vessel lid assembly of claim 7 wherein the insulation cavity is vacuum sealed.

10. The drinking vessel lid assembly of claim 7 wherein the insulation cavity is located between an upper surface of the subassembly main body and a lower surface of the subassembly main body.

11. The drinking vessel lid assembly of claim 1, wherein the lid main body further includes a sealing member guide extending upwardly toward the drinking aperture, the sealing member having a guide element engageable with the sealing member guide to guide movement of the sealing element from the opened position to the closed position when the subassembly main body is in the insertion position and the sealing member actuator is operated to move the sealing element upward from the opened position to the closed position.

12. The drinking vessel lid assembly of claim 1 wherein the subassembly main body has a cylindrical shape, and the attachment collar has an annular shape at least partially surrounding the subassembly main body.

13. The drinking vessel lid assembly of claim 1 wherein the subassembly main body includes a cylindrical subassembly sidewall, an upper retainer portion at least partially extending about the subassembly sidewall and projecting outward therefrom, and a lower retainer portion at least partially extending about the subassembly sidewall and projecting outwardly therefrom, the upper and lower portions being vertically spaced apart, and wherein the attachment collar includes an inwardly projecting collar portion at least partially extending thereabout and extending between the upper and lower portions so as to retain the collar portion therebetween and limit vertical movement of the attachment collar relative to the subassembly main body while permitting at least rotational movement of the attachment collar relative to the subassembly main body.

14. The drinking vessel lid assembly of claim 1 wherein the attachment collar includes a first rotational stop and a second rotational stop peripherally spaced apart, and the subassembly main body includes a protruding portion positioned between the first rotational stop and the second rotational stop and configured to engage the first rotational stop and the second rotational stop to limit the range of rotational movement of the attachment collar about the subassembly main body.

15. The drinking vessel lid assembly of claim 14 wherein the attachment collar further includes an inwardly projecting first flange portion extending about a first peripheral portion of the attachment collar and an inwardly projecting second flange portion, extending about a second peripheral portion of the attachment collar, the first rotational stop being positioned at an end of the first flange portion, and the second rotational stop being positioned at an end of the second flange portion.

16. The drinking vessel lid assembly of claim 1 wherein the lid subassembly includes a handle projecting downwardly from the attachment collar.

17. The drinking vessel lid assembly of claim 1, further comprising:

a drinking aperture cover disposed on an upper surface of the upper portion of the lid main body, the drinking aperture cover being rotatable between a first cover position covering the drinking aperture and a second cover position spaced away from the drinking aperture, the drinking aperture cover being rotatable about an axis of rotation transverse to an axis of rotation of the attachment collar.

18. The drinking vessel lid assembly of claim 17, wherein the lid main body includes a lip portion adjacent to the drinking aperture, and the drinking aperture cover includes an end portion that extends downward and covers at least a portion of the lip portion when the drinking aperture cover is in the first cover position.

19. The drinking vessel lid assembly of claim 1 wherein first attachment element includes a plurality of circumferentially spaced apart first attachment members, and the second attachment element includes a plurality of circumferentially spaced apart second attachment members, each of the second attachment members being arranged to overlay one of the first attachment members when the lid assembly is in the integrated and the attachment collar is rotated to secure the lid assembly to the lid main body.

20. The drinking vessel lid assembly of claim 1, wherein the sealing member includes an engagement portion comprising one of a cam and a cam follower, and the sealing member actuator is inwardly movable and has an engagement portion comprising the other of the cam and the cam follower, the engagement portion of the sealing member actuator is arranged to engage the engagement member of the sealing member and apply a downwardly directed operating force to the engagement portion of the sealing member during inward movement of the sealing member actuator to cause the engagement portion of the sealing member actuator to move the engagement portion of the sealing member downward and thereby move the sealing element from the closed position to the opened position when the lid subassembly is in the integration configuration.

21. A drinking vessel lid assembly for attachment to a drinking vessel, the drinking vessel lid assembly comprising:

a lid main body including:

an upper portion having a drinking aperture;

a cavity inner wall extending downwardly from the upper portion and defining a downwardly opening lid cavity having an open lower end portion and an inner peripheral surface, and a first attachment portion on the inner peripheral surface of the lid cavity;

a lid subassembly removably attachable to the lid main body, the lid subassembly including:

a sealing member supporting a sealing element;

a subassembly main body supporting the sealing member with the sealing member extending upwardly from the subassembly main body, the subassembly main body being removably insertable to an insertion position within the lid cavity with the sealing member restrained against rotation within the lid cavity, the sealing element configured for upward displacement into a closed position whereat the sealing element seals the drinking aperture, and for downward displacement into an opened position whereat the sealing element is spaced apart from the drinking aperture when the subassembly main body is in the insertion position; and an attachment collar rotatable relative to the subassembly main body and, when the subassembly main body is in the insertion position, the attachment collar being configured to rotate about an upwardly extending axis of rotation relative to the subassembly main body without rotating the sealing member relative to the lid main body when the subassembly main body is in the insertion position within the lid cavity, the attachment collar being rotatable relative to the subassembly main body to secure the lid subassembly in an integrated configuration in which the lid subassembly is secured to the lid main body with the subassembly main body in the insertion position, and to selectively transition the lid subassembly between the integrated position and a cleaning configuration in which the lid subassembly is separable from the lid main body, the attachment collar including a second attachment portion engageable with the first attachment portion when the lid subassembly is in the insertion position to secure the lid subassembly to the lid main body with the subassembly main body in the insertion position; and a sealing member actuator supported by with the lid main body, the sealing member actuator including a button portion operable to move the sealing element from the closed position to the opened position when the lid subassembly is in the integrated configuration.

22. A drinking vessel assembly comprising:

a drinking vessel having a downwardly extending beverage cavity having an open upper end portion;

a lid body attachable to the drinking vessel, the lid body including:

an upper portion having a drinking aperture laterally offset from a central axis of the upper portion and extending partially about the upper portion at an outer edge portion thereof;

a lid cavity extending downwardly from the upper portion;

a first attachment portion; and a lower portion attachable to the open upper end portion of the drink vessel;

a lid subassembly including:

a subassembly main body removably insertable to an insertion position within the lid cavity and held therein with the sealing member restrained against rotation relative to the lid main body;

a sealing member extending upwardly from the subassembly main body, the sealing member having a sealing element configured for upward displacement in the lid cavity into a closed position whereat the sealing element seals the drink aperture, and for downward displacement in the lid cavity into an opened position whereat the sealing element is spaced apart from the drinking aperture when the subassembly main body is in the insertion position, when the subassembly is in the insertion position within the lid cavity the sealing element is positioned in vertical alignment with the drinking aperture; and an attachment collar rotatable relative to the subassembly main body without rotating the sealing member relative to the lid main body when the subassembly main body is in the insertion position within the lid cavity to maintain the sealing element in vertical alignment with the drinking aperture, the attachment collar being rotatable relative to the subassembly main body to secure the lid subassembly in an integrated configuration in which the lid subassembly is secured to the lid body with the subassembly main body in the insertion position, and to selectively transition the lid subassembly between the integrated configuration and a cleaning configuration in which the lid subassembly is separable from the lid body, the attachment collar including a second attachment portion engageable with the first attachment portion when the lid subassembly is in the integrated configuration to secure the lid subassembly to the lid body with the subassembly main body is in the insertion position; and a sealing member actuator supported by the lid body, the sealing member actuator being operable to move the sealing element from the closed position to the opened position when the lid subassembly is in the integrated configuration.

23. The drinking vessel of claim 22, further including a resilient member positioned to move the sealing element from the opened position to the closed position when the sealing member actuator is not being operated.

24. A lid for removable attachment to a drinking vessel, comprising:

a lid body including:

an upper portion having a drinking aperture;

a lid cavity extending downwardly from the upper portion;

a first attachment portion; and a drinking vessel attachment portion attachable to the drinking vessel;

a lid subassembly including:

a subassembly main body removably insertable to an insertion position within the lid cavity whereat upward movement of the subassembly main body within the lid cavity is prevented;

a sealing member supported by the subassembly main body and having a sealing element, when the subassembly main body is in the insertion position the sealing member being restrained against rotation within the lid cavity with the sealing element in alignment with the drinking aperture, upwardly moveable within the lid cavity to move the sealing element into a closed position whereat the sealing element seals the drink aperture, and downwardly moveable within the lid cavity to move the sealing element into an opened position whereat the sealing element is spaced apart from the drinking aperture; and a retaining member having a second attachment portion, the retaining member being selectively movable relative to the subassembly main body between a first position with the second attachment portion in engagement with the first attachment portion to releasable hold the subassembly main body stationary in the insertion position within the lid cavity, and a second position with the second attachment portion out of engagement with the first attachment portion to allow the subassembly main body and the sealing member to be inserted into and removed from the lid cavity, during movement of the retaining member between the first and second positions with the subassembly main body in the insertion position within the lid cavity, the sealing member being restrained against rotation within the lid cavity with the sealing element in alignment with the drinking aperture; and a sealing member actuator supported by the lid body and operable to move the sealing member downward to move the sealing element from the closed position to the opened position when the subassembly main body is in the insertion position.

25. The lid of claim 24, wherein the lid body has a guide portion which the sealing member slidably engages and which guides the upward and downward movement of the sealing element within the lid cavity.

26. The lid of claim 25, wherein the guide portion retains the sealing member for linear upward and downward movement of the sealing member within the lid cavity.

27. The lid of claim 24, wherein the subassembly main body has an upper wall portion and the sealing member has a lower support portion rigidly attached thereto and extending upward therefrom into the lid cavity to which the sealing element is movably attached.

28. The lid of claim 24, wherein the sealing member actuator is inwardly moveable to move the sealing member downward and thereby move the sealing element from the closed position to the opened position, and the lid body has a guide portion which the sealing member slidably engages and which guides the downward movement of the sealing member within the lid cavity in response to inward movement of the sealing member actuator.

29. The lid of claim 24, wherein when the retaining member portion is in the second position with the second attachment portion out of engagement with the first attachment portion, the subassembly main body and the sealing member are fully removable from the lid cavity and disconnectable from the lid body.

30. The lid of claim 24, further including a resilient member positioned when the subassembly main body is in the insertion position to move the sealing member upward within the lid cavity to move the sealing element into the closed position after termination of operation of the sealing member actuator moved the sealing member downward and placed the sealing element in the opened position.

31. The lid of claim 24, wherein the retaining member is selectively rotatable between the first position and the second position.

32. The lid of claim 24, wherein the lid body includes an outer perimeter sidewall and the sealing member actuator includes a manually operable actuator portion positioned at the outer perimeter sidewall and engageable by a user to effectuate movement of the sealing member downward to move the sealing element from the closed position to the opened position.

33. The lid of claim 24, wherein the sealing member includes an engagement portion comprising one of a cam and a cam follower, and the sealing member actuator is inwardly movable and has an engagement portion comprising the other of the cam and the cam follower, the engagement portion of the sealing member actuator is arranged to engage the engagement member of the sealing member and apply a downwardly directed operating force to the engagement portion of the sealing member during inward movement of the sealing member actuator to cause the engagement portion of the sealing member actuator to move the engagement portion of the sealing member downward and thereby move the sealing element from the closed position to the opened position when the subassembly main body is in the insertion position.

34. A drinking vessel lid assembly for attachment to a drinking vessel, the drinking vessel lid assembly comprising:

a lid main body including:

an upper portion having a drinking aperture;

a lid cavity extending downwardly from the upper portion; and a first attachment element;

a lid subassembly removably attachable to the lid main body, the lid subassembly including:

a sealing member supporting a sealing element;

a subassembly main body supporting the sealing member with the sealing member extending upwardly from the subassembly main body, the subassembly main body being removably insertable to an insertion position within the lid cavity and held therein with the sealing member restrained against rotation relative to the lid main body and the sealing element in vertical alignment with the drinking aperture, the sealing element configured for upward displacement into a closed position whereat the sealing element seals the drinking aperture, and for downward displacement into an opened position whereat the sealing element is spaced apart from the drinking aperture when the subassembly main body is in the insertion position; and an attachment collar rotatably attached to the subassembly main body and configured to rotate relative to the subassembly main body without rotating the sealing member relative to the lid main body when the subassembly main body is in the insertion position within the lid cavity to maintain the sealing element in vertical alignment with the drinking aperture, the attachment collar being rotatable relative to the subassembly main body to secure the lid subassembly in an integrated configuration in which the lid subassembly is secured to the lid main body with the subassembly main body in the insertion position, and to selectively transition the lid subassembly between the integrated configuration and a cleaning configuration in which the lid subassembly is separable from the lid main body, the attachment collar including a second attachment element engageable with the first attachment element when the lid subassembly is in the integrated configuration to secure the lid subassembly to the lid main body with the subassembly main body in the insertion position; and a manually operable sealing member actuator operable to move the sealing element from the closed position to the opened position when the lid subassembly is in the integrated configuration.

35. The drinking vessel lid assembly of claim 34, wherein the lid main body further includes an outer perimeter sidewall, and the sealing member actuator has a manually operable actuator portion positioned at the outer perimeter sidewall and engageable by a user to effectuate movement of the sealing element from the closed position to the opened position.

* * * * *